US005967901A

United States Patent [19]

Briggs

[11] Patent Number: 5,967,901

[45] Date of Patent: Oct. 19, 1999

[54] PLAY STRUCTURE WITH WATER SPRAYS AND SPOUTS

[76] Inventor: Rick A. Briggs, 64 Maple Grove, Springfield, Ill. 62707

[ * ] Notice: This patent is subject to a terminal disclaimer.

[21] Appl. No.: 08/846,116

[22] Filed: Apr. 24, 1997

Related U.S. Application Data

[63] Continuation of application No. 08/460,101, Jun. 2, 1995, Pat. No. 5,662,525, which is a continuation of application No. 08/333,373, Dec. 16, 1994, abandoned, which is a continuation of application No. 08/025,143, Mar. 2, 1993, Pat. No. 5,405,294, which is a continuation of application No. 07/604,946, Oct. 29, 1990, Pat. No. 5,194,048, which is a continuation-in-part of application No. 07/438,220, Nov. 20, 1989, Pat. No. Des. 330,579.

[51] Int. Cl.[6] ..... A63G 31/00

[52] U.S. Cl. ..... 472/128; 482/35

[58] Field of Search ..... 472/117, 128, 472/116, 77, 137; 482/35–37

[56] References Cited

U.S. PATENT DOCUMENTS

| | | | |
|---|---|---|---|
| D. 241,664 | 9/1976 | Ewers et al. . | |
| D. 250,783 | 1/1979 | Dieter et al. . | |
| D. 250,784 | 1/1979 | Dieter et al. . | |
| D. 251,262 | 3/1979 | Barrett et al. . | |
| D. 330,579 | 10/1992 | Briggs . | |
| 1,529,467 | 3/1925 | Davis et al. . | |
| 3,539,181 | 11/1970 | Larsen . | |
| 4,014,540 | 3/1977 | Caulkins | 472/118 X |
| 4,057,244 | 11/1977 | Gaspar . | |
| 4,145,042 | 3/1979 | Becker et al. . | |
| 4,149,710 | 4/1979 | Rouchard . | |
| 4,487,411 | 12/1984 | Ahrens | 472/116 |
| 4,573,679 | 3/1986 | Janszen . | |
| 4,799,665 | 1/1989 | Bracy . | |
| 4,805,897 | 2/1989 | Dubeta . | |
| 4,805,898 | 2/1989 | Jacober et al. . | |
| 4,898,198 | 2/1990 | Castlebury | 472/118 X |
| 5,194,048 | 3/1993 | Briggs . | |
| 5,213,547 | 5/1993 | Lochtefeld . | |
| 5,378,197 | 1/1995 | Briggs | 472/128 |
| 5,387,159 | 2/1995 | Hilgert et al. | 472/128 |
| 5,405,294 | 4/1995 | Briggs | 472/128 |
| 5,662,525 | 9/1997 | Briggs | 472/128 |

FOREIGN PATENT DOCUMENTS 1031693 6/1958 Germany .

OTHER PUBLICATIONS

Playthings Yards of Fun (Sep. 1987).
SCS Company Brochure.
Splash World Water Park Association Magazine (Sep. 1989).
Mexico Forge 3800 Series.
Sandman Playground Equipment The Christiana (Apr. 9, 1987).
Gym–Dandy Scout Walker Command Tower (Mar. 24, 1984).

*Primary Examiner*—Carl D. Friedman
*Assistant Examiner*—Beth Aubrey
*Attorney, Agent, or Firm*—Knobbe, Martens, Olson & Bear, LLP

[57] ABSTRACT

A play structure is provided for use in a playground or park. The play structure includes a wading pool containing a swing with an overhead water spray, a slide, a roof structure over the slide, a waterfall originating on the roof structure and cascading downward onto the slide, a climbing structure to allow access to the slide, a tunnel on rollers underneath the climbing structure, swinging rings with overhead water sprays, water spouts, and faucets for activating the water sprays and spouts.

26 Claims, 5 Drawing Sheets

PLAY STRUCTURE WITH WATER SPRAYS AND SPOUTS

RELATED APPLICATIONS

This application is a continuation of U.S. Design Pat. No. D330,579, entitled PLAYGROUND STRUCTURE, and priority is based on co-pending application Ser. No. 08/460,101 filed Jun. 2, 1995, now U.S. Pat. No. 5,662,525 which is a continuation of U.S. Ser. No. 08/333,373, filed Dec. 16, 1994, now abandoned, which is a continuation of U.S. Ser. No. 08/025,143, filed Mar. 2, 1993, now U.S. Pat. No. 5,405,294, which is a continuation of U.S. Ser. No. 07/604,946, filed Oct. 29, 1990 now U.S. Pat. No. 5,194,048, which is a continuation-in-part of U.S. Ser. No. 07/438,220, filed Nov. 20, 1989, now said U.S. Pat. No. Des.330,579.

BACKGROUND OF THE INVENTION

1. Field of the Invention

This invention relates generally to play structures for use in a playground or park and, more particularly, to a play structure having overhead water sprays, water spouts and faucets for activating the water sprays and spouts.

2. Description of the Related Art

Recreational water theme parks have grown in popularity over the years. Most water theme parks consist primarily of ride or "thrill" attractions. The most popular among these are water slides in which participants slide down a wet trough or tunnel and splash down into a pool of water. While thrill attractions are very popular among older children and adults they are often unsuited for small children. Facilities for entertaining small children have generally been limited to wading pools, miniature water slides and static play structures.

SUMMARY OF THE INVENTION

In one embodiment the present invention provides a play structure for use in a playground or park comprising a wading pool containing a swing, a slide, a climbing structure to allow access to the slide, a plurality of water sprays or water spouts, and faucets for activating the water sprays and spouts.

In another embodiment the present invention provides a play structure for use in a playground or park comprising a climbing structure, a plurality of water forming devices disposed on the climbing structure at different locations and/or elevations for spraying water, and a plurality of water control devices for selectively activating the water forming devices.

In another embodiment the present invention provides a play structure for use in a playground or park comprising a climbing structure having multiple platforms at different locations and/or elevations a plurality of playground attractions supported by the climbing structure, a plurality of water forming devices disposed on the climbing structure at different locations and/or elevations, and a plurality of water control devices for selectively activating the water forming devices.

These and other objects and advantages of the present invention will become readily apparent to those skilled in the art from the following detailed description of the preferred embodiment having reference to the appended drawings.

DESCRIPTION OF THE PREFERRED EMBODIMENT

Figure 1:
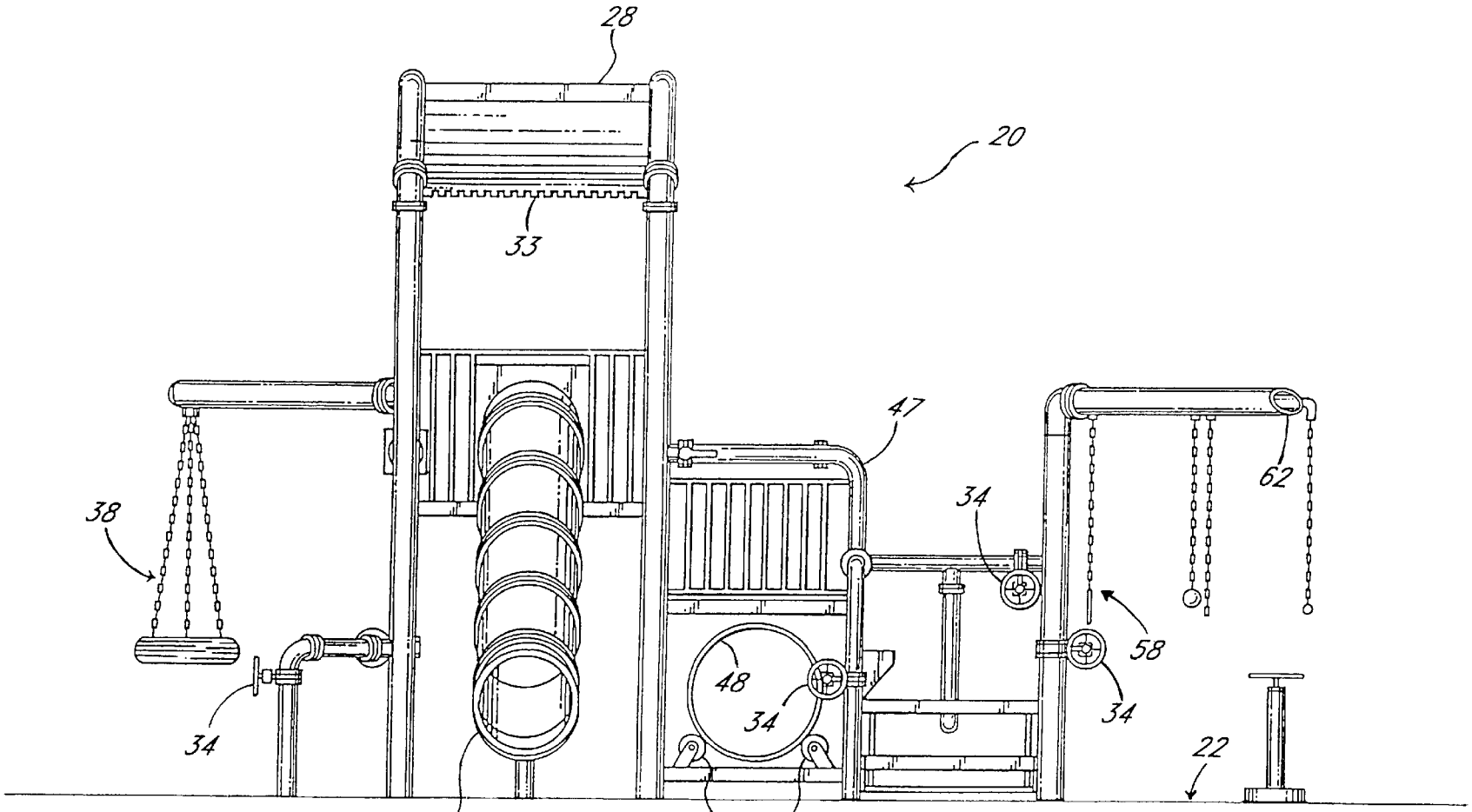
FIG. 1 is a front elevational view of a play structure having features in accordance with the present invention.
Figure 2:
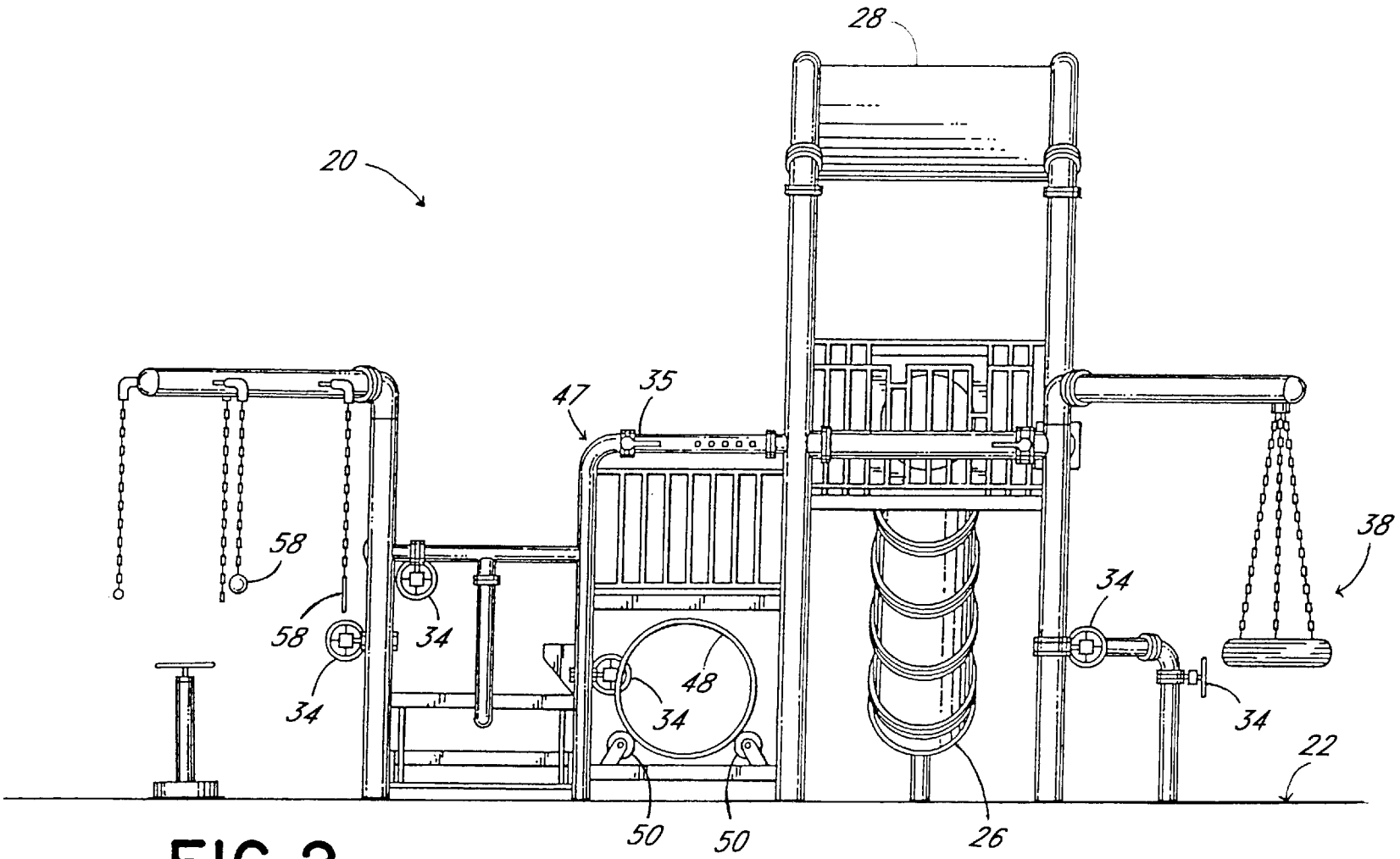
FIG. 2 is a rear elevational view of the play structure of FIG. 1.
Figure 3:
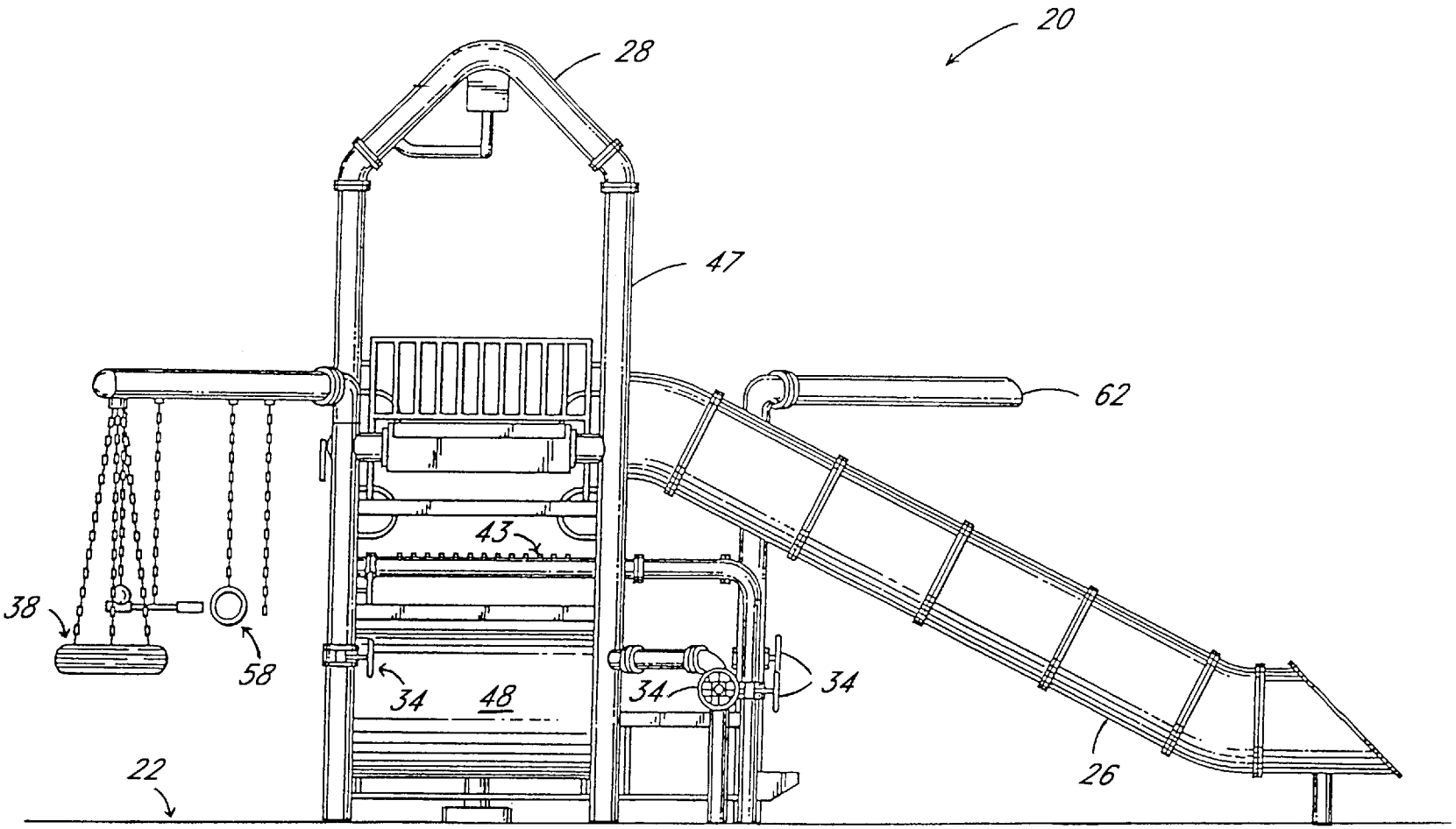
FIG. 3 is a right side elevational view of the play structure of FIG. 1.
Figure 4:
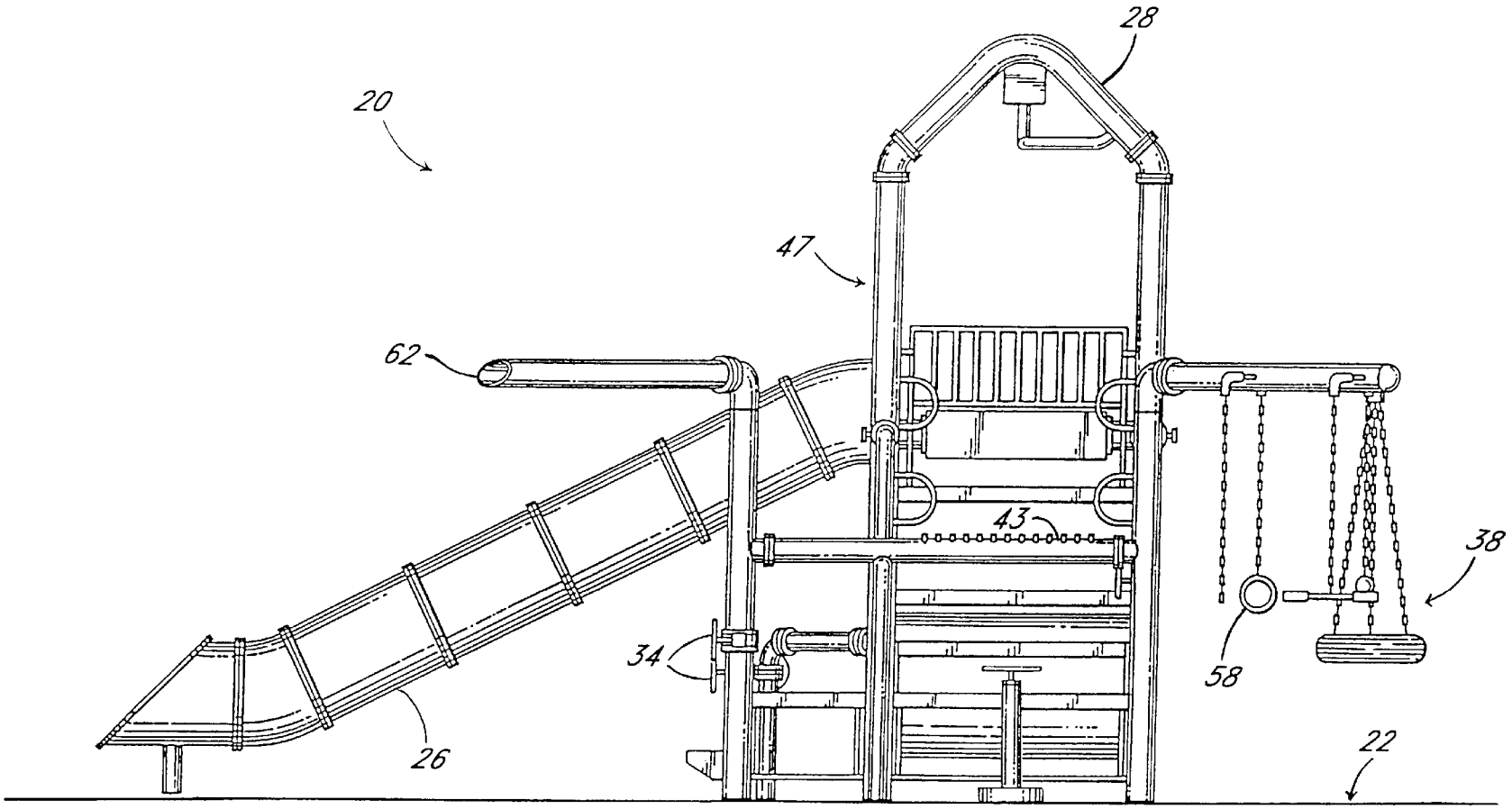
FIG. 4 is a left side elevational view of the play structure of FIG. 1.
Figure 5:
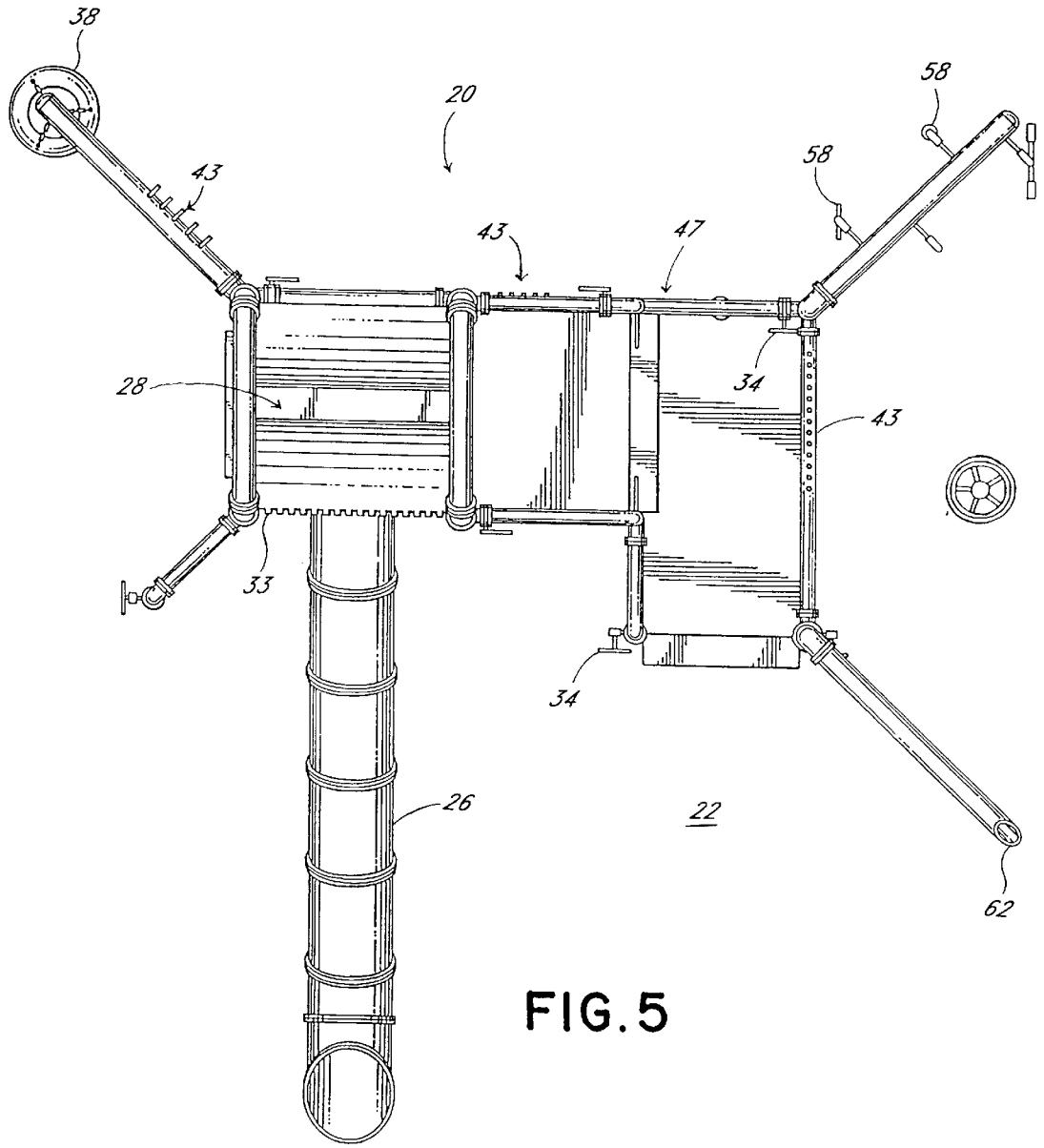
FIG. 5 is a top plan view of the play structure of FIG. 1.

Referring to the preferred embodiment shown in FIGS. 1–5 the present invention provides a play structure 20 for use in a playground or park. The play structure 20 is substantially as shown in FIGS. 1–5 and includes a wading pool 22 containing a swing 38 with an overhead water spray 43, a slide 26, a roof structure 28 over the slide 26, a waterfall 33 originating on the roof structure 28 and cascading downward onto the slide 26, a climbing structure 47 to allow access to the slide 26, a tunnel 48 on rollers 50 underneath the climbing structure 47, swinging rings 58 with overhead water sprays 43, water spouts 62, and faucets 34, 35 for activating the water sprays 43 and spouts 62.

Having thus described the invention, it will be readily apparent to those skilled in the art that the present invention extends beyond the specific preferred embodiment shown and described. Accordingly, the scope of the present invention should be determined only by a fair reading of the claims that follow.

What is claimed is:

1. A play structure for use in a playground or park comprising a swing, a slide, a climbing structure to allow access to the slide, a plurality of water sprays or water spouts on the climbing structure, and faucets at different locations and elevations and disposed and arranged so that play participants can activate the water sprays and spouts.

2. The play structure as recited in claim 1 wherein the slide comprises an enclosed tubular slide.

3. The play structure as recited in claim 1 further comprising a roof structure over the slide.

4. The play structure as recited in claim 1 further comprising a tunnel on rollers underneath the climbing structure.

5. The play structure as recited in claim 1 further comprising swinging rings.

6. The play structure as recited in claim 1 wherein the water sprays or spouts comprise a series of nozzles arranged in a linear array.

7. A play structure for use in a playground or park comprising:

a climbing structure;

a plurality of water forming devices disposed on the climbing structure at different locations for spraying water; and a plurality of water control devices at different locations and elevations and disposed and arranged so that play participants can selectively activate the water forming devices.

8. The play structure as recited in claim 7 wherein the water forming devices comprise a plurality of water sprays or water spouts and wherein the water control devices comprise a plurality of faucets for activating the water sprays and spouts.

9. The play structure as recited in claim 8 wherein the water sprays or spouts comprise a series of nozzles arranged in a linear array.

10. The play structure as recited in claim 7 further comprising a swing depending from the climbing structure.

11. The play structure as recited in claim 10 wherein the swing comprises a tire swing.

12. The play structure as recited in claim 7 further comprising a slide adapted to be accessed by the climbing structure.

13. The play structure as recited in claim 12 wherein the slide comprises an enclosed tubular slide.

14. The play structure as recited in claim 12 further comprising a roof structure over the slide.

15. The play structure as recited in claim 7 further comprising a tunnel on rollers underneath the climbing structure.

16. The play structure as recited in claim 7 further comprising swinging rings depending from the climbing structure.

17. A play structure for use in a playground or park comprising:

a climbing structure having multiple platforms at different locations and elevations;

a plurality of playground attractions supported by the climbing structure;

a plurality of water forming devices disposed on the climbing structure at different locations and elevations; and a plurality of water control devices sized and arranged on the climbing structure so as to allow play participants to selectively activate the water forming devices.

18. The play structure as recited in claim 17 wherein the water forming devices comprise a plurality of water sprays or water spouts and wherein the water control devices comprise a plurality of faucets for activating the water sprays and spouts.

19. The play structure as recited in claim 18 wherein the water sprays or spouts comprise a series of nozzles arranged in a linear array.

20. The play structure as recited in claim 17 wherein at least one of the playground attractions comprises a swing depending from the climbing structure.

21. The play structure as recited in claim 20 wherein said swing comprises a tire swing.

22. The play structure as recited in claim 17 wherein at least one of the playground attractions comprises a slide supported by the climbing structure.

23. The play structure as recited in claim 22 wherein the slide comprises an enclosed tubular slide.

24. The play structure as recited in claim 22 further comprising a roof structure over the slide.

25. The play structure as recited in claim 17 wherein at least one of the playground attractions comprises a tunnel on rollers underneath the climbing structure.

26. The play structure as recited in claim 17 wherein at least one of the playground attractions comprises swinging rings depending from the climbing structure.

* * * * *